United States Patent [19]

Pettersson

[11] 4,314,798

[45] Feb. 9, 1982

[54] APPARATUS FOR ARRANGEMENT OF COMBINED STATIONARY AND SLIP FORM CASTING OF CONCRETE

[76] Inventor: John P. Pettersson, Pl. 1130, 760 15 Gräddö, Sweden

[21] Appl. No.: 130,610

[22] Filed: Mar. 17, 1980

[30] Foreign Application Priority Data

Mar. 16, 1979 [SE] Sweden ..... 7902383

[51] Int. Cl.[3] ..... B28B 17/00

[52] U.S. Cl. ..... 425/63; 249/10; 249/19; 425/65

[58] Field of Search ..... 425/59, 63, 65; 249/10, 249/19

[56] References Cited

U.S. PATENT DOCUMENTS

| | | | |
|---|---|---|---|
| 1,393,506 | 10/1921 | Copeland | 425/65 |
| 1,628,752 | 5/1927 | Sproul et al. | 425/65 |
| 1,638,583 | 8/1927 | Keller | 425/65 |
| 3,497,579 | 2/1970 | Barron | 425/63 |
| 3,705,776 | 12/1972 | Johansson | 425/65 |
| 4,076,778 | 2/1978 | Whitting | 425/63 |

*Primary Examiner*—Donald E. Czaja
*Assistant Examiner*—W. Thompson
*Attorney, Agent, or Firm*—Silverman, Cass & Singer, Ltd.

[57] ABSTRACT

An arrangement for combined stationary form and slipform casting, including a slipform yoke capable of carrying two form halves, between which concrete is to be poured, for example for a wall or the like.

According to the invention, the form halves each comprise a so-called supporting form half which can be expanded in the casting direction, i.e. usually upward in vertical direction, so that the area of the support wall of the supporting form half after expansion has substantially been increased, for example almost doubled. The resulting support surface of the supporting form half is intended to serve as a support in an additional form half.

5 Claims, 8 Drawing Figures

APPARATUS FOR ARRANGEMENT OF COMBINED STATIONARY AND SLIP FORM CASTING OF CONCRETE

This invention relates to an arrangement for casting concrete walls by using a combination of stationary and slipforms. The arrangement also could be called a climb-slip form.

Concrete walls often are cast by using either so-called climbforms or so-called slipforms. A climbform subtantially comprises two parallel upright walls, so-called form halves, between which concrete is poured. Climbforms often are lifted at fixed steps by means of a crane when a wall is being cast. A slipform also comprises two form halves, but different from a climbform, is caused to successively slide upwards while concrete is being poured substantially continuously or at equal time intervals.

The rising rate at slipform casting is about 1 m/8 hours, i.e. 1 m/shift. At three-shift construction work the rising rate, thus, is 3 m/day. The rising rate is limited by the setting time of the concrete, becaue a lower wall portion already cast is utilized for guiding and supporting the slipform.

Wages constitute a substantial part of the variable construction costs, and it is, therefore, strongly desired to make a more efficient use of the concrete setting time, so that less than three entire shifts are required for casting at maintained rising rate per day.

It also is often desirable to change between slipform and stationary form casting, among other things for being able to adjust the casting to fluctuations in construction work intensity and to other activites going on on the construction site. Such changes require at present exchange of the form type, which is tedious and expensive work. Casting with stationary forms is carried out at fixed great steps in such a manner, that a relatively large wall portion is cast and permitted to solidify at every step. There is, therefore, demand for a form which can be utilized as a stationary form as well as a slipform.

The present invention, which relates to a combined stationary and slipform, renders it possible to case at the highest possible rising rate per day by working only in two shifts.

The invention also renders it possible to change between stationry form casting and slipform casting to the extent desired, without form exchange.

The invention further permits simple casting of section walls, block walls or the like.

The present invention relates to an arrangement for combined stationary form and slipform casting, comprising a slipform yoke capable of carrying two form halves, between which concrete is to be poured, for example for a wall or the like.

The invention is characterized in that said form halves each comprise a so-called supporting form half, which is expansible in the casting direction, so that the support surface of the supporting form half after expansion has increased substantially, for example doubled, and the resulting support surface of the supporting form half is capable to serve as a support in a further form half.

Figure 1:
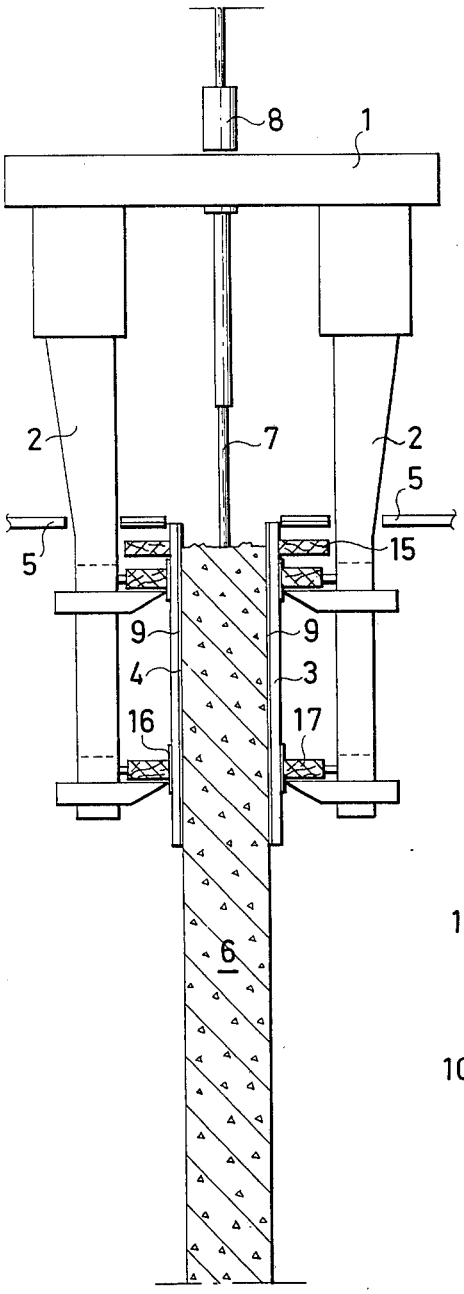
Figure 2:
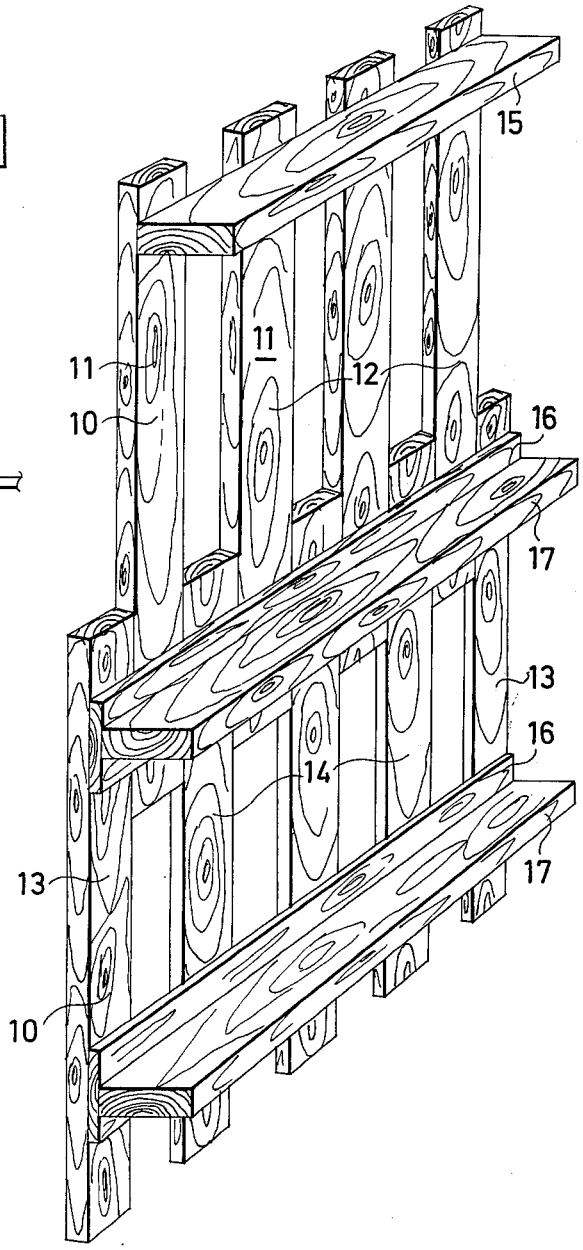
Figure 5:
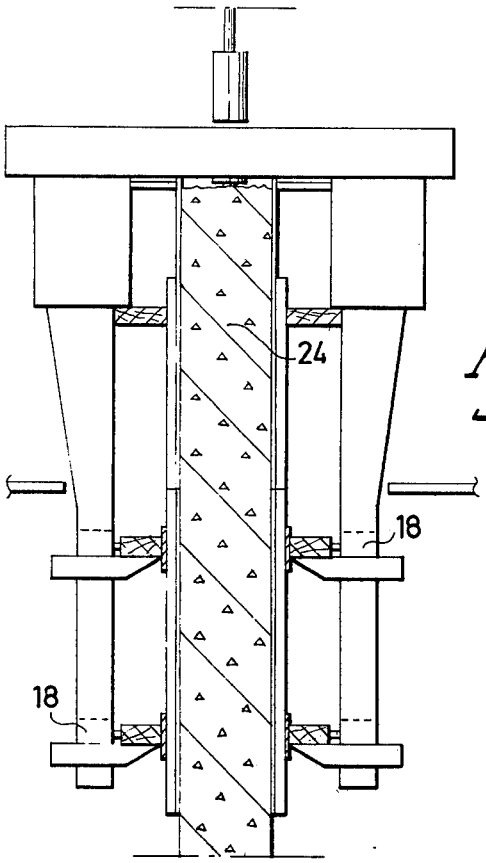
Figure 6:
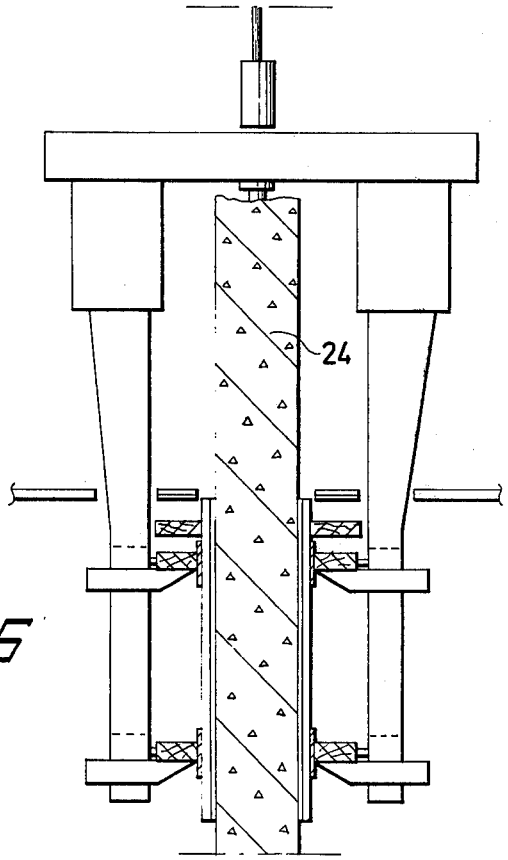
Figure 7:
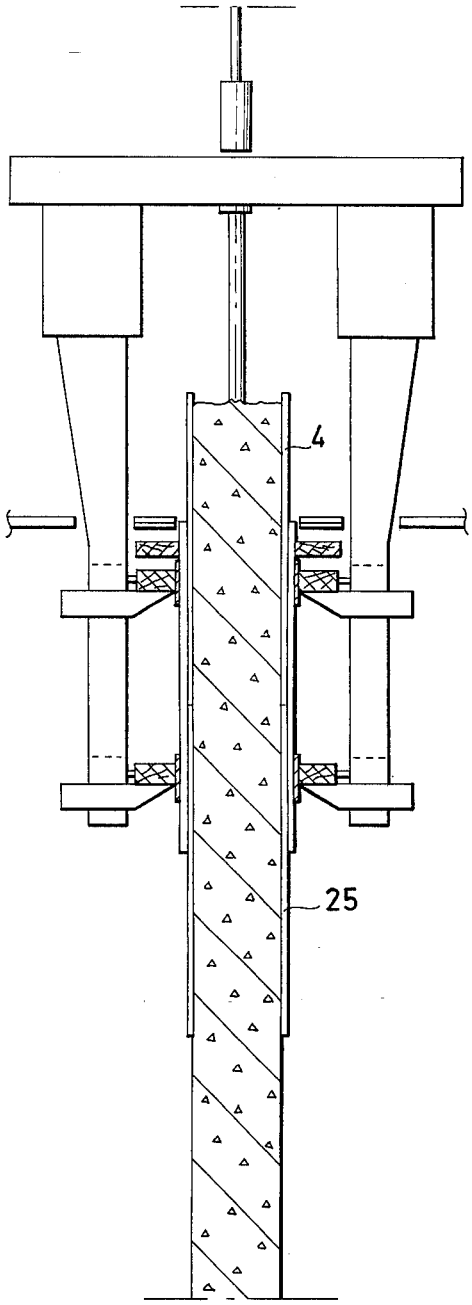
Figure 8:
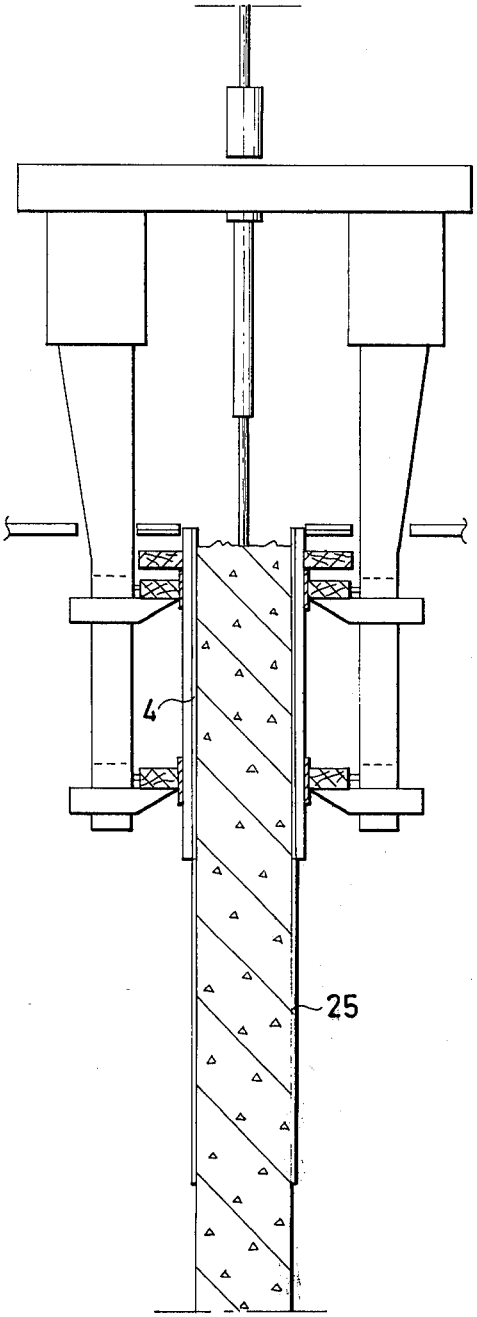

The invention is described below in greater detail, with reference to the accompanying drawings, in which FIG. 1 is a schematic sectional view of an arrangement according to the invention, FIG. 2 is a perspective view of a supporting form half according to the invention, FIG. 3—6 show in sequence the arrangement utilized in a first embodiment according to the present invention, FIGS. 7 and 8 show in sequence the arrangement utilized in a second embodiment according to the present invention.

In FIG. 1 a slipform is shown, on which the present invention is applied. The slipform comprises a slipform yoke 1, which is carried on two yoke legs 2. Each yoke leg 2 is capable of carrying a form half 3–4 as shown in FIG. 1. It may also occur that the form halves 3–4, besides being carried by the yoke legs 2, are carried by stays between a working deck 5 and the yoke legs 2. Concrete is intended to be poured between the form halves 3–4. A vertical wall portion already cast is designated by 6. The yoke 1, thus, is substantially horizontal, and the yoke legs 2 are substantially vertical when a vertical wall is being cast.

It is assumed in this description that a vertical wall is to be cast and, therefore, several details are referred to as being vertical or horizontal. When a wall is to be cast which forms a certain angle with a vertical plane, the said details in applicable cases will assume a corresponding inclination.

A vertical jack pipe 7 is inserted in the wall 6 already cast and intended to project upward through the slipform yoke 1. Connected to the slipform yoke 1 a jack 8 or the like is provided and intended to act as lifting means for the slipform by means of the jack pipe 7, with which the jack 8 co-operates.

Each form half 3–4 comprises substantially a supporting form half 3 and a form panel 4, for example of plywood, which is intended to be located between the supporting form half 3 and the concrete and is supported by the supported form half 3. The form halves 3 have inner surfaces facing one another.

According to the present invention, every supporting form half 3 is expansible in the casting direction, i.e. upward in FIGS. 1 and 2. After the expansion, the area of the support wall 9 of the supporting form half is intended to be increased substantially, for example doubled. The resulting support wall of the supporting form half is capable of acting as a support in an expanded portion of a form half, as will become apparent from the following.

In FIG. 2 an embodiment of said expansible supporting form half 3 is shown in partially expanded state.

Prior to the expansion, the support wall of such a supporting form half consists of substantially identical boards 10, which are located in one plane in parallel and side by side one another. The supporting form half is arranged so, that alternating boards or every second board 10–11 is associated with a first upper portion 12 of the supporting form half, and every other second board 10–13 is associated with a second lower portion 14 of the supporting form half. Each board 10,11,13 according to FIG. 2, of course, can consist of a group of two or more boards 10 arranged in a corresponding manner.

The said portions are so arranged, for example by transverse boards 15,16 and 17 joining the boards associated with each portion, that expansion of the supporting form half is effect by first portion 12 being moved upward in the longitudinal direction of the boards 10 in relation to the second portion 14. After the expansion, thus, as shown in FIG. 2, said support surface has increased in size and substantially consists of boards 11,13 located to the side of one another, where the distance between two adjacent boards slightly exceeds their width in the plane of the support wall 9.

In order to render possible among other things support of the supporting form halves, transverse boards 15,16 and 17 are provided.

The numeral 18 designates means, which are provided in connection with the yoke legs 2 and said supporting form halves 3 and arranged so, that the position of the supporting form halves 3 in relation to the cast concrete 6 can be varied in a direction substantially perpendicular or normal to the casting direction. The means 18, which for example may be pneumatically or hydraulically operated cylinders, further are so arranged that the pressure of the supporting form halves against the cast concrete, the pressure on formwork, can be varied, and among other things be entirely relieved. In FIG. 1 an embodiment of these means is shown, but a variety of embodiments, of course, can be imagined.

In FIGS. 3–6 casting by means of a form for combined stationary and slipform casting according to the present invention is shown in successive steps. The mode of operation of the invention is described below with reference to said Figures.

Figure 3:
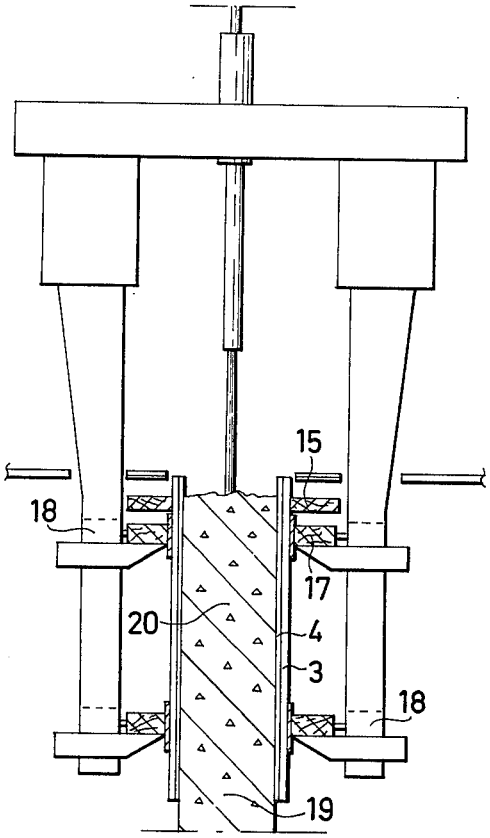

In FIG. 3 a situation of slipform casting is shown where casting with successive upward movement of the form has gone on, for example, for almost two 8-hours shifts. The lower wall portion 19 in FIG. 3 has solidified and can assist in supporting the form arrangement. The upper wall portion 20, however, has not solidified and consequently has relatively low carrying capacity. If the casting would continue with a conventional slipform at the highest rising rate permitted by the setting time of the concrete, i.e. about 3 m/day, an additional 8-hours shift of slipform casting would be required.

By means of the present invention, instead, slipform casting is exchanged against stationary form casting, whereby about one hour before the end of the second shift arrangements according to above are made, while slipform casting is going on, to cast before the end of this shift a wall portion, which substantially corresponds to the portion which can be cast by slipform casting during one shift. This arrangement is established in the manner as follows.

Figure 4:
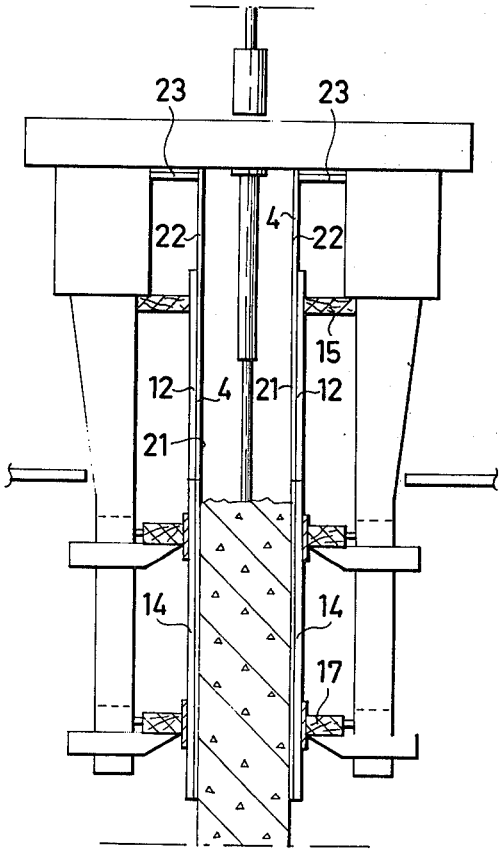

In FIG. 4 a situation is shown, where a stationary form portion has been brought about by means of the invention. The upper portion 12 of each supporting form half 3 has been lifted, whereby the supporting form half has expanded and the area of the support wall has increased substantially by a portion 21. A form panel 4 further has been placed in connection to the resulting support surface 21. The form panels 4 preferably project upward above the supporting form halves and, thus, have a free portion 22. The resulting stationary form arrangement is supported against the yoke legs 2 by means of the transverse boards 15 on portion 12 and by means of transverse supporting boards 23 at the upper free portion 22 of the form panels 4, as shown in FIG. 4.

Before the end of said second shift the slipform casting is stopped, and a wall portion 24 substantially corresponding to the height of the stationary form portion is cast in one step, as appears from FIG. 5. Thereafter the casting operation is stopped, and the concrete poured in the wall portion 24 solidifies for about eight hours, i.e. one shift.

In FIG. 5, thus, also a situation is shown where the concrete poured in the stationary form portion has solidified during one shaft, and a new first shift is started. The pressure on formwork is relieved by the means 18, which are provided for this purpose, and a small clearance between the form halves and the cast concrete is brought about.

The expansible supporting form halves are pushed together to a position corresponding to that shown in FIGS. 3 and 6, i.e. to the unexpanded position, and the form panels 4 associated with the stationary form portion are removed.

Hereby a condition is achieved as shown in FIG. 6. From this condition the form arrangement is lifted to a position corresponding to that shown in FIG. 3, whereafter pressure on formwork again is applied by the means 18. Slipform casting can now be carried out for two shifts. During the last hour of the second shift a new cycle comprising stationary form casting as described above is commenced.

In FIGS. 7 and 8 an alternative arrangement is shown, where the form panels 4 arranged somewhat different from the case described above. In FIG. 7 a condition is shown subsequent to that shown in FIG. 5. The form panels 25 associated with the original slipform portion have been detached from the supporting form halves portions 14, and the supporting form halves 3 have been pushed together to an unexpanded position. The supporting form halves 3 further have been lifted in relation to the two form panels 4 in connection to each supporting form half 3. The form panels 4 associated with the stationary portion in this way replace the form panels 25 of the slipform portion after the supporting form halves 3 have been lifted additionally, and slipform casting is carried out during two eight-hour shifts, see FIG. 8. The original form panels 25 of the slipform portion are hooked in a suitable way on the slipform portion and later on are dismounted and used when the stationary form portion is to be arranged during the final phase of the second shift.

As has become apparent, the present invention offers the possibility of casting with a number of hands corresponding to two shifts with the highest rate permitted by the setting time of the concrete. A conventional form requires a number of hands corresponding to three shifts. It is further possible to change between slipform casting and stationary form casting to the extent desired.

The invention also renders it possible to cast section walls or the like, which cannot be cast with conventional forms. The section is changed at the change between the form types, i.e. stationary form and slipform.

A plurality of alternative embodiments of the invention, of course, can be imagined without abandoning the invention idea. The supporting form halves, for example, can be arranged to expand in a different way than described here. The supporting form halves may also be designed in a different way. A number of different embodiments of the means 18 can also be imagined.

The invention, thus, must not be regarded restricted to the embodiments described above, but can be varied within the scope of the attached claims.

I claim:

1. An apparatus for combined stationary form and slipform casting in one direction comprising:

A. A slipform yoke having a pair of substantially parallel depending legs;

B. A pair of form halves carried between the yoke legs, each form half having a support wall facing the other support wall, a form panel on the facing sides of each support wall between which the concrete may be poured, and the form halves including means which are upwardly expansible in said one direction to substantially increase the area of the support walls by a factor of about two, each support wall having an upper and lower portion movable with respect to each other and each formed from a plurality of generally parallel boards extending vertically, the boards of the two portions being interdigitated to permit said upward expansion

2. An apparatus as defined in claim 1 wherein the distance between adjacent boards or board groups on each wall portion slightly exceeds the width of the boards or board groups in the plane of the support wall.

3. The apparatus as claimed in claim 6 and further including means for moving said form halves in a direction normal to said one direction, said means being provided on the depending legs, so that the position of said form halves can be varied normal to said one direction and so that the pressure of said form halves against any concrete poured therebetween can be varied.

4. The apparatus as claimed in claim 3 in which the lower portion of each form half is provided with transverse boards extending normal to the longitudinal direction of the parallel boards, the transverse boards having a thickness so that the lower portion when the form half is expanded can be supported by said depending legs.

5. An apparatus as defined in claim 3 wherein the form panels have portions which extend above the associated support wall and support board means between the extending portions of said form panels and said depending legs, said support board means being normal to the longitudinal axes of the boards.

* * * * *